US009063511B2

(12) United States Patent
Nakano et al.

(10) Patent No.: US 9,063,511 B2
(45) **Date of Patent: *Jun. 23, 2015**

(54) IMAGE FORMING APPARATUS

(71) Applicant: Brother Kogyo Kabushiki Kaisha, Nagoya, Aichi (JP)

(72) Inventors: Hiroshi Nakano, Aichi (JP); Shougo Sato, Seto (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/589,787

(22) Filed: Jan. 5, 2015

(65) Prior Publication Data

US 2015/0125197 A1 May 7, 2015

Related U.S. Application Data

(63) Continuation of application No. 14/467,372, filed on Aug. 25, 2014, which is a continuation of application No. 14/153,232, filed on Jan. 13, 2014, now Pat. No. 8,862,044, which is a continuation of application No. 13/075,229, filed on Mar. 30, 2011, now Pat. No. 8,666,276.

(30) Foreign Application Priority Data

May 27, 2010 (JP) ..... 2010-121926

(51) Int. Cl.
*G03G 15/00* (2006.01)
*G03G 21/12* (2006.01)
*G03G 15/16* (2006.01)

(52) U.S. Cl.
CPC ..... *G03G 21/12* (2013.01); *G03G 2221/1678* (2013.01); *G03G 15/161* (2013.01)

(58) Field of Classification Search
CPC ..... G03G 15/161; G03G 2221/1678
USPC ..... 399/34, 99, 101, 123, 258, 360
See application file for complete search history.

(56) References Cited

U.S. PATENT DOCUMENTS 5,967,687 A 10/1999 Oike
6,937,838 B2 * 8/2005 Ishii et al. ..... 399/358

(Continued)

FOREIGN PATENT DOCUMENTS

JP 10-039566 A 2/1998
JP 11-003015 1/1999

(Continued)

OTHER PUBLICATIONS

Notice of Allowance dated May 8, 2012 from related JP 2010-121926.

(Continued)

*Primary Examiner* — David Gray
*Assistant Examiner* — Michael Harrison
(74) *Attorney, Agent, or Firm* — Scully, Scott, Murphy & Presser, PC

(57) ABSTRACT

An image forming apparatus is provided. The image forming apparatus includes a chassis having an opening, a cover, photosensitive members, an intermediate transfer belt, a primary-transfer member, a secondary-transfer roller, a cleaner device, a waste toner container, which is movable along a predetermined direction to be removably installed in the chassis through the opening and stores residual toner, a connector, and a feed roller, which is arranged within the feeding path to feed the recording sheet in the feeding path. The feed roller is arranged in a position to at least partially fall within a vertical range of the waste toner container and to be aligned with the waste toner container along an axial direction of the second feed roller.

13 Claims, 10 Drawing Sheets

(56) References Cited

U.S. PATENT DOCUMENTS

| | | | | |
|---|---|---|---|---|
| 7,257,349 | B2 | 8/2007 | Kotozaki | |
| 7,603,056 | B2 * | 10/2009 | Kamimura | 399/110 |
| 7,852,638 | B2 | 12/2010 | Kondo et al. | |
| 8,139,979 | B2 | 3/2012 | Koishi et al. | |
| 8,270,856 | B2 | 9/2012 | Mizutani et al. | |
| 8,331,834 | B2 | 12/2012 | Koetsuka et al. | |
| 8,385,771 | B2 | 2/2013 | Mori et al. | |
| 2005/0281581 | A1 | 12/2005 | Kitozaki | |
| 2008/0007935 | A1 | 1/2008 | Kondo et al. | |
| 2010/0080622 | A1 | 4/2010 | Uchida | |
| 2010/0189483 | A1 | 7/2010 | Inoue | |

FOREIGN PATENT DOCUMENTS

| | | | |
|---|---|---|---|
| JP | 2000-006574 | | 1/2000 |
| JP | 2002-014503 | | 1/2002 |
| JP | 2004-279919 | A | 10/2004 |
| JP | 2006-030958 | | 2/2006 |
| JP | 2006-153973 | | 6/2006 |
| JP | 2007-140144 | A | 6/2007 |
| JP | 2008-028988 | | 2/2008 |
| JP | 2008-158230 | | 7/2008 |
| JP | 2009-018924 | | 1/2009 |
| JP | 2009-109854 | | 5/2009 |
| JP | 2010-102303 | | 5/2010 |

OTHER PUBLICATIONS

U. S. Official Action dated Jun. 7, 2013 from parent U.S. Appl. No. 13/075,229.

Notice of Allowance dated Oct. 15, 2013 from parent U.S. Appl. No. 13/075,229.

Notice of Allowance dated May 21, 2014 from parent U.S. Appl. No. 14/153,232.

Notice of Allowance dated Oct. 9, 2014 from parent U.S. Appl. No. 14/467,372.

* cited by examiner

IMAGE FORMING APPARATUS

CROSS REFERENCE TO RELATED APPLICATION

This application is a continuation application of U.S. Ser. No. 14/467,372 filed on Aug. 25, 2014, which is a continuation application of U.S. Ser. No. 14/153,232 filed on Jan. 13, 2014, now U.S. Pat. No. 8,862,044 granted on Oct. 14, 2014, which is a continuation application of U.S. Ser. No. 13/075,229 filed on Mar. 30, 2011, now U.S. Pat. No. 8,666,276 granted on Mar. 4, 2014 and claims priority from Japanese Patent Application No. 2010-121926, filed on May 27, 2010; the entire subject matter of each of which are incorporated herein by reference.

BACKGROUND

1. Technical Field

An aspect of the present invention relates to an image forming apparatus, specifically having an intermediate transfer belt, to which a toner image is transferred from one or more photosensitive members, and a waste toner container, which stores residues such as residual toner removed from the intermediate transfer belt.

2. Related Art

An image forming apparatus having a waste toner container, in which residual toner collected from an intermediate transfer belt is stored, is known. The waste toner container may be arranged below the intermediate transfer belt and removed therefrom through an opening, which is formed on a side surface of a chassis of the image forming apparatus. The image forming apparatus may have a secondary-transfer roller, which serves in cooperation with the intermediate transfer belt to transfer a toner image formed on a surface of the belt to a sheet of paper, and a feed roller, which feeds the sheet from a sheet tray in a feeding path to a nipped position between the intermediate transfer belt and the secondary-transfer roller. The secondary-transfer roller and the feed roller may be arranged in positions on a side opposite from the opening for the waste toner container. Therefore, in such configuration, the feeding path extending from an outlet of the sheet tray to the secondary-transfer roller may be formed on the side opposite from the chassis opening.

SUMMARY

Meanwhile, an image forming apparatus may be configured to have an external-sheet inlet, through which externally-supplied sheets are manually inserted. With the external-sheet inlet, it is preferable that an opening for the inlet is formed on the same side as the opening for installation and removal of the waste toner container for convenience of handling and placement of the image forming apparatus. Further, in such a configuration, a feed roller to convey the externally-supplied sheets is required to be arranged in the vicinity of the sheet-inlet opening.

When the feed roller is arranged in the vicinity of the opening for the waste toner container, however, the feed roller may undesirably interfere with the waste toner container being removed from or installed in the image forming apparatus through the opening, which is in the vicinity of the sheet-inlet opening.

In view of the above drawbacks, the present invention is advantageous in that an image forming apparatus having an opening for installation and removal of the waste toner container and the feed roller for externally-supplied sheets on the same side, in which the waste toner container can be installed and removed easily, is provided.

According to an aspect of the present invention, an image forming apparatus to form an image on a recording sheet is provided. The image forming apparatus includes a chassis having a first opening, which is formed on a first side of the chassis, a cover, which is movable between an open position and a closed position to expose and close the first opening, a plurality of photosensitive members, which are set in the chassis and carry toner images, an intermediate transfer belt, which is an endless rolling belt arranged to have a surface thereof facing the plurality of photosensitive members and to have the toner images on the plurality of photosensitive members transferred onto the surface in cooperation with a plurality of primary-transfer members, a secondary-transfer roller, which is arranged on a second side opposite from the first side within the chassis and transfers the toner images on the surface of the intermediate transfer belt onto the recording sheet, a first feed roller, which is arranged in vicinity of the second side and conveys the recording sheet in a feeding path toward the secondary-transfer roller, a cleaner device, which is arranged in a position between one of the plurality of photosensitive members being in a most upstream position along a rolling direction of the intermediate transfer belt and the secondary-transfer roller, to collect residual toner from the surface of the intermediate transfer belt, a waste toner container, which is movable along a predetermined direction to be removably installed in the chassis through the first opening and settled in a position opposite from the plurality of photosensitive members across the intermediate transfer belt, to store the residual toner collected by the cleaner device, a connector, which is connected to the cleaner device, and to which the waste toner container is detachably attached, to convey the residual toner collected by the cleaner device to the waste toner container, a first feeding path, which extends in a range between the first feed roller and the secondary-transfer roller, a second feeding path, which is a path for a recording sheet being inserted through a sheet inlet, the sheet inlet being formed on the first side of the chassis, and merges into the first feeding path in the vicinity of the first feed roller, and a second feed roller, which is arranged in the second feeding path to convey the recording sheet. The second feed roller is arranged in a position to at least partially fall within a vertical range of the waste toner container and to be aligned with the waste toner container along an axial direction of the second feed roller.

According to another aspect of the present invention, an image forming apparatus to form an image in toner on a recording sheet being conveyed in a feeding path is provided. The image forming apparatus includes a chassis having an opening formed on one side thereof, a waste toner container, which is movable along a predetermined direction to be removably installed in the chassis through the opening and stores residual toner, a feed roller, which is arranged within the feeding path to feed the recording sheet in the feeding path, wherein the feed roller is arranged in a position to at least partially fall within a vertical range of the waste toner container and to be aligned with the waste toner container along an axial direction of the second feed roller.

BRIEF DESCRIPTION OF THE ACCOMPANYING DRAWINGS

DETAILED DESCRIPTION

Hereinafter, an embodiment according to an aspect of the present invention will be described with reference to the accompanying drawings.

[Overall Configuration of the MFP]

The MFP 1 is a multicolor-enabled MFP, equipped with a plurality of image processing functions including a scanning function, a printing function, a copier function, a facsimile transmission/receiving function, and a function for reading/writing data in a memory medium.

Figure 1:
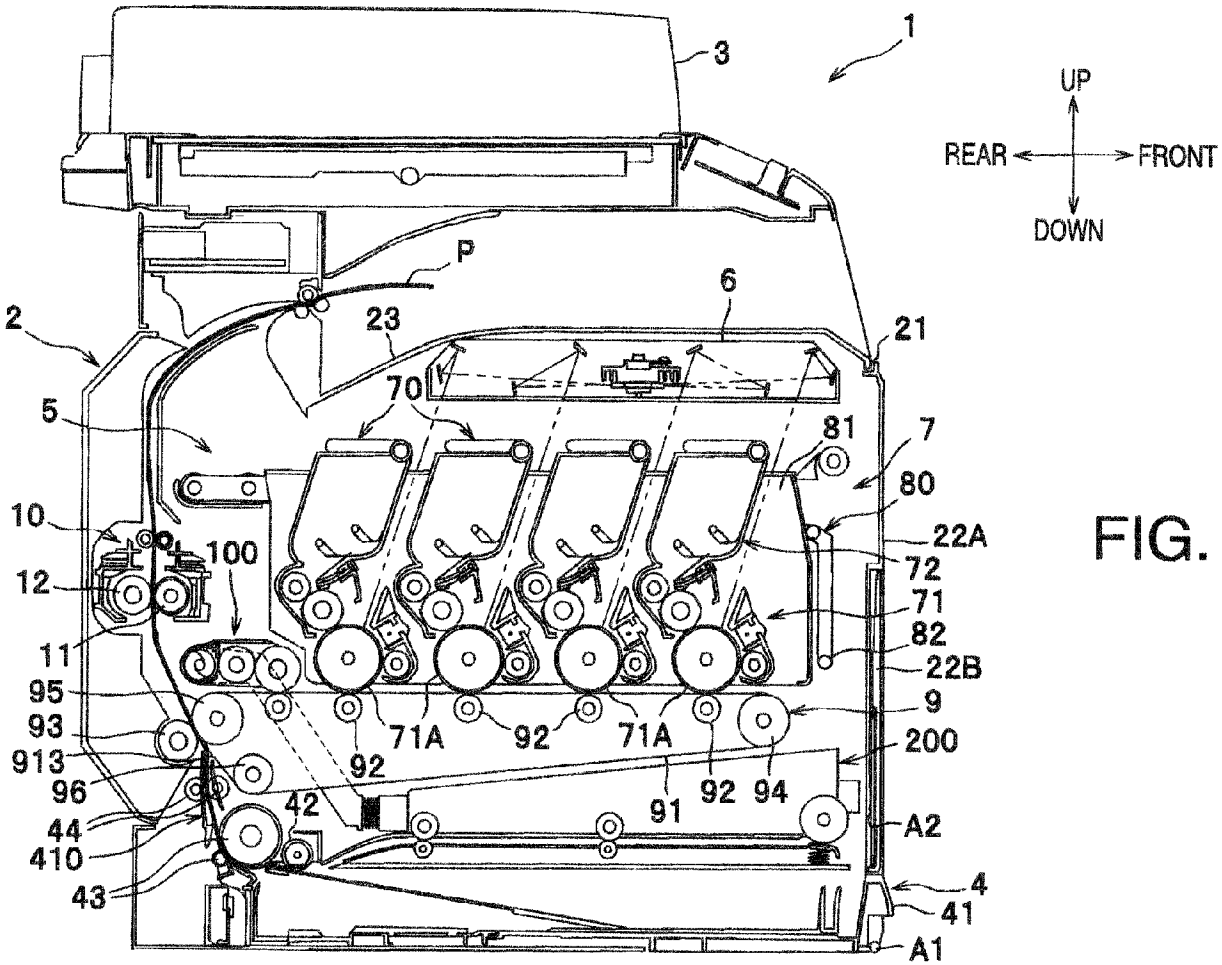
FIG. 1 is a cross-sectional side view of a multicolor MFP (multi-function peripheral) according to an embodiment of the present invention.
Figure 2:
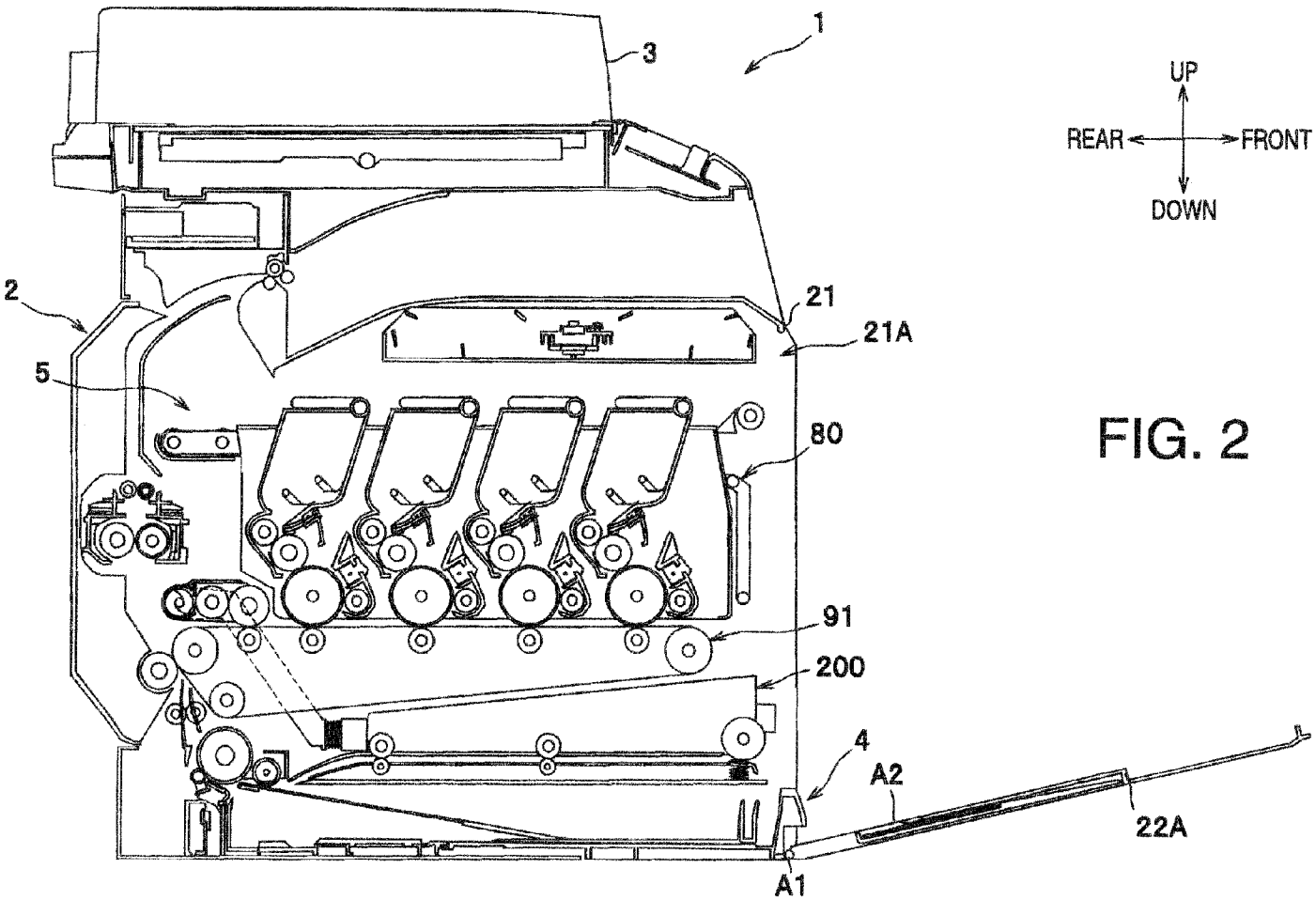
FIG. 2 is a cross-sectional side view of the MFP according to the embodiment of the present invention with a front cover being open.
Figure 3:
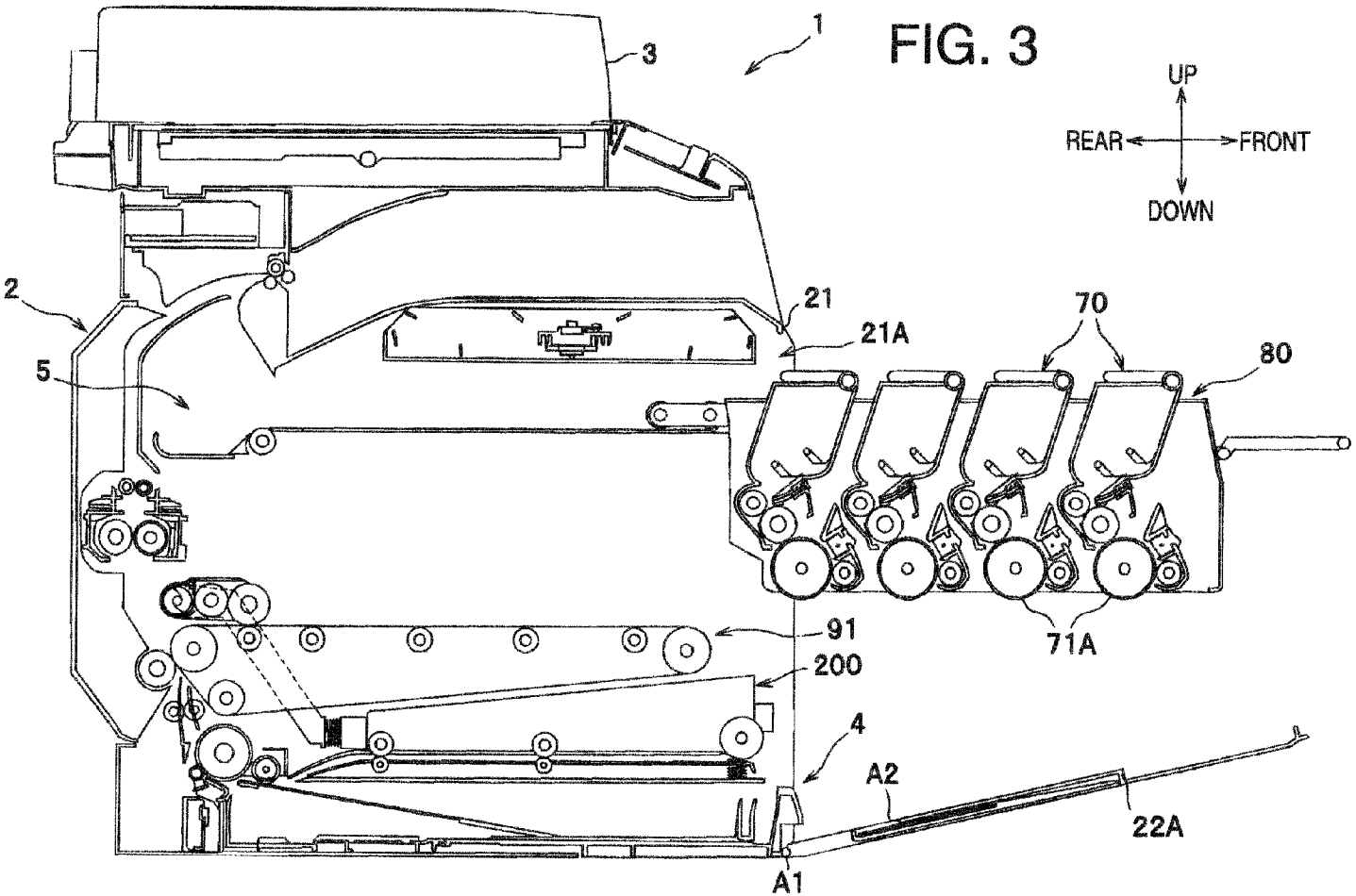
FIG. 3 is a cross-sectional side view of the MFP with a drawer drawn out of a chassis of the MFP according to the embodiment of the present invention.
Figure 4:
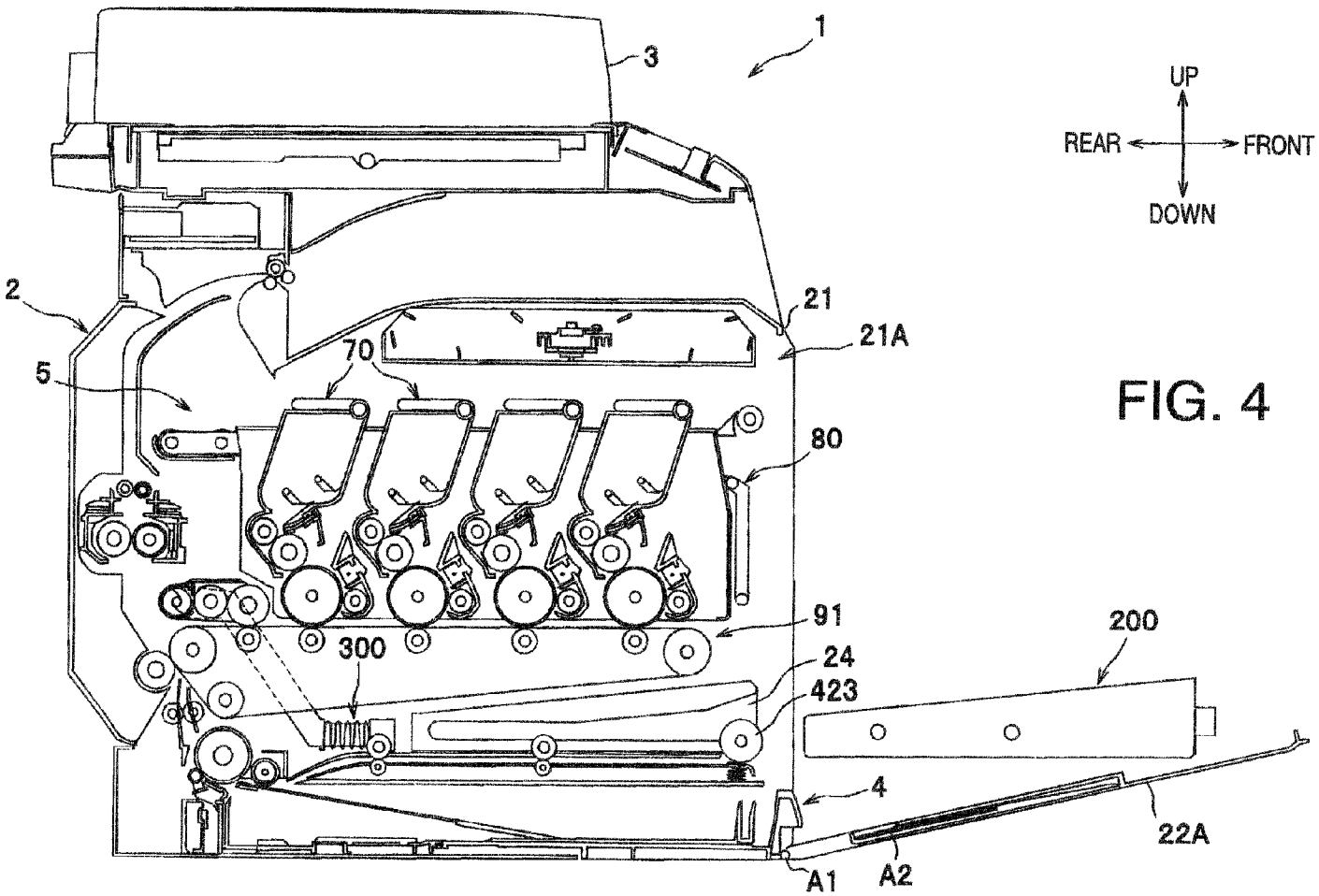
FIG. 4 is a cross-sectional side view of the MFP with a waste toner container removed out of the chassis of the MFP according to the embodiment of the present invention.

In the present embodiment, directions concerning the MFP 1 will be referred to in accordance with orientation as indicated by arrows in each drawing. Therefore, for example, a viewer's right-hand side appearing in FIG. 1 is referred to as a front side of the MFP 1, and left-hand side in FIG. 1 opposite from the front side is referred to as rear. A side which corresponds to the viewer's nearer side is referred to as left, and an opposite side from the left, which corresponds to the viewer's further side is referred to as right. The up-down direction in FIG. 1 corresponds to a vertical direction of the MFP. Further, directions of the drawings in FIGS. 2-8 are similarly based on the orientation of the MFP 1 as defined above and correspond to those with respect to the MFP 1 shown in FIG. 1 even when the drawings are viewed from different angles. In cross-sectional views in the accompanying drawings, hatchings are omitted unless specifically required in order to simplify the illustration.

The MFP 1 according to the embodiment includes a chassis 2 and a flatbed scanner 3, which is arranged on top of the chassis 2. The MFP 1 further has a sheet-feed unit 4, which feeds recording sheets P of paper in a sheet feeding path, and an image forming unit 5, which forms images on the sheets P being fed, inside the chassis 2.

The chassis 2 is formed to have an opening 21A (see FIGS. 2-4) on a front side 21 thereof. The opening 21A is an opening, through which a drawer 80 to hold processing cartridges 70 and a waste toner container 200 are installed in and removed from the chassis 2. The opening 21A is covered by a front cover 22A, which is rotatable about a lower edge A1 thereof between an open position (see FIG. 1) and a closed position (see FIGS. 2-4) to cover and expose the opening 21A.

The front cover 22A is arranged in an upper position with respect to a sheet-feed tray 41. Further, the front cover 22A is formed to have a bottom-open rectangular-shaped smaller opening A2, which is open-ended at the lower edge A1. The opening A2 is an opening, through which the sheet-feed tray 41 can be installed in and removed from the chassis 2, and height and width thereof are greater than those of the sheet-feed tray 41.

The smaller opening A2 in the front cover 22A can be covered by an external feed tray 22B. The external feed tray 22B is a sheet tray, on which unused sheets P to be manually fed in the sheet feeding path are set. The external feed tray 22B is rotatable about a rotation axis B2 with respect to the front cover 22A to cover and uncover an upper part of the smaller opening A2. The rotation axis B2 of the external feed tray 22B extends in a slightly higher position with respect to a lower edge B1 of the external feed tray 22B; therefore, when the external feed tray 22B is opened (see FIG. 5), the lower edge B1 of the external feed tray 22B is drawn inside the chassis 2. Further, when the external feed tray 22B is in an open position, an upper surface of the external feed tray 22B (i.e., an inner surface when closed), a right-side edge, a left-side edge, and an upper edge of the smaller opening A2 serve as an external-sheet inlet 421. The sheet P manually inserted through the external-sheet inlet 421 is conveyed in a second feeding path 420, which directs the sheet P to a first feed roller 42. The second feeding path 420 and the first feed roller 42 will be described later in detail.

The flatbed scanner 3 (see FIG. 1) arranged on top of the chassis 2 is a known document reader, which irradiates light onto a source document to read an image formed thereon and creates image data representing the read image.

The sheet-feed unit 4 is arranged in a lower section of the chassis 2. The sheet-feed unit 4 includes the sheet-feed tray 41, the first feed roller 42, a separator roller 43, and conveyer rollers 44. The sheet-feed tray 41 is removably installed in the chassis 2, through the smaller opening A2 of the front cover 22A, in a lower position with respect to the second feeding path 420.

The sheet-feed tray 41 is a container to store unused sheets P. The first feed roller 42 is arranged in an upper-rear position with respect to the sheet-feed tray 41 and picks up the sheets P from the sheet-feed tray 41. The sheets P having been picked up by the first feed roller 42 are separated by the separator roller 43 and conveyed upwardly by the conveyer rollers 44 one-by-one to a position between an intermediate transfer belt 91 and a secondary transfer roller 93 in the image forming unit 5.

The image forming unit 5 includes an exposure unit 6, a photosensitive developer unit 7, a belt unit 9, and a fixing unit 10.

The exposure unit 6 is arranged in an upper section in the chassis 2 and includes a laser-beam source (unsigned), a polygon mirror, a lens, and a reflection mirror (not shown). Laser beams emitted from the laser-beam source for yellow, cyan, magenta, and black colors are reflected on the polygon mirrors and the reflection mirrors and transmit through the lenses to be casted to scan on surfaces of photosensitive drums 71A. Double-dotted lines shown in FIG. 1 represent paths of the laser beams.

The photosensitive developer unit 7 is arranged in a lower section with respect to the exposure unit 6 and a higher section with respect to the belt unit 9. The photosensitive developer unit 7 includes four (4) processing cartridges 70, which are aligned in line in a front-rear direction, and a drawer 80, which detachably holds the processing cartridges 70.

Each of the processing cartridges 70 has a drum cartridge 71 in a lower section and a developer cartridge 72, which is detachably attached to a top section of the drum cartridge 71.

The drum cartridge 71 includes a photosensitive drum 71A and a charger (unsigned). Whilst four (4) drum cartridges 71 are aligned in line in the front-rear direction, four (4) photosensitive drums 71A are also aligned in line in the front-rear direction.

Each of the developer cartridges 72 is equipped with a developer roller, a supplier roller, and a toner container (unsigned). Each toner container contains nonmagnetic monocomponent toner in one of cyan, magenta, yellow, and black colors.

The drawer 80 includes a main frame 81, which holds the processing cartridges 70, and a rotatable handle 82, which is arranged on a front side of the main frame 81. The drawer 80 is slidable in the chassis 2 in the front-rear direction to be installed in and removed from the chassis 2 through the opening 21A (see FIGS. 2 and 3). In particular, the drawer 80 is movable between an installed position, in which the entire drawer 80 is settled in the chassis 2 (see FIG. 1), and a removed position, in which the drawer 80 is removed out of the chassis 2 (see FIG. 3).

In the photosensitive developer unit 7 configured as above, the charger electrically charges a surface of the photosensitive drum 71A evenly, and the surface of the photosensitive drum 71A is exposed to the laser beam emitted based on image data from the exposure unit 6 in order to form a lower-potential regions, i.e., an electrostatic latent image, thereon.

Meanwhile, the toner in the developer cartridge 72 is supplied to the latent image on the photosensitive drum 71A via the supplier roller and the developer roller. Thus, the latent image is developed to be a toner image carried on the surface of the photosensitive drum 71A.

The belt unit 9 is arranged in a lower position with respect to the photosensitive developer unit 7 and includes an intermediate transfer belt 91, four (4) primary-transfer rollers 92, a secondary-transfer roller 93, a driving roller 94, and two (2) driven rollers 95, 96. In particular, the driven roller 96 is arranged in a rear section of the chassis 2 and in a vertically overlapping position with the driven roller 95. The MFP 1 has a cleaner device 100 and a waste toner container 200, which will be described later in detail, in positions in the vicinities of the belt unit 9.

The intermediate transfer belt 91 is an endless belt extended to roll around rollers 94, 95, 96, which are arranged in a shape of a flat-triangular wedge when viewed from a side, in a clockwise direction in FIGS. 1-5 and FIG. 6A. More specifically, the intermediate transfer belt 91 has a first plane 911, which extends between the driving roller 94 being a front end portion and the driven roller 95 being a rear end portion horizontally to face the photosensitive drums 71A and the cleaner device 100, a second plane 912, which extends from the front end portion (i.e., the driving roller 94) of the first plane 911 downwardly in an inclined angle (e.g., toward lower left) to the driven roller 96, and a third plane 913, which extends from the rear end portion (i.e., the driven roller 95) of the first plane 911 downwardly in an inclined angle (e.g., toward lower right) to meet a rear end portion (i.e., the driven roller 96) of the second plane 912 (see FIG. 6A). Specifically, the second plane 912 is in contact with the driven roller 96, which is in the rear section of the chassis 2, and extends from the rear section of the chassis 2 in an upward-inclined angle to a section in a vicinity of the front side 21 of the chassis 2.

The intermediate transfer belt 91, the first feed roller 42, and other sheet-feeding components such as a sheet guide (unsigned) are arranged in predetermined positions to have the sheet P conveyed by the first feed roller 42 to become in contact with the third plane 913 of the intermediate transfer belt 91 (see FIG. 1). The sheet P being in contact with the third plane 913 is conveyed by the rolling movement of the intermediate transfer belt 91 along the third plane 913 to a nipped position between the driven roller 95 and the secondary-transfer roller 93. When the sheet P is not carried along the third plane 913 but is carried in a path apart from the intermediate transfer belt 91 until the sheet P becomes in the vicinity of the secondary-transfer roller 93, electricity may be discharged between the third plane 913 of the intermediate transfer belt 91 and the sheet P. However, in the present embodiment, the discharge of electricity can be reduced due to the sheet P being in contact with the intermediate transfer belt 91 at the third plane 913.

The primary-transfer rollers 92 are arranged in positions to oppose the photosensitive drums 71A with the intermediate transfer belt 91 intervening therebetween and in contact with an upper internal surface of the intermediate transfer belt 91. The secondary-transfer roller 93 is arranged on a side opposite from the opening 21A within the chassis 2 in a position to oppose the secondary-transfer roller 93 via the rear end portion of the intermediate transfer belt 91. When the toner images are transferred to the surface of the intermediate transfer belt 91 and to the sheet P, transfer bias which enables the image transfer is applied to the primary-transfer rollers 92 and the secondary-transfer roller 93 respectively.

In particular, the toner images formed on the photosensitive drums 71A in four colored toners are primarily transferred onto an upper external surface in the first plane 911 of the intermediate transfer belt 91 in layers in cooperation with the rotating primary-transfer rollers 92 and the applied transfer bias. The toner images formed in colors on the intermediate transfer belt 91 are secondarily transferred onto the sheet P when the sheet P is conveyed through the section between the intermediate transfer belt 91 and the secondary-transfer roller 93 in cooperation with the rotating secondary roller 93 and the applied transfer bias.

The fixing unit 10 is arranged in an upper position with respect to the secondary-transfer roller 93 and includes a heat roller 11 and a pressure roller 12, which is in a position opposite from the heat roller 11, to press the heat roller 11.

The sheet P with the transferred toner images is carried to a nipped section between the heat roller 11 and the pressure roller 12 in the fixing unit 10 to have the toner images thermally fixed thereon. The sheet P with the fixed image is ejected out of the chassis 2 by discharge rollers (unsigned) and settled in a discharge tray 23.

[Configuration and Surroundings of the Waste Toner Container]

Configuration of the waste toner container 200 and surroundings thereof will be described in detail.

The cleaner device 100 (see FIG. 6A), which is connected to the waste toner container 200 by a connector 300 (described later) will be described. The cleaner device 100 is to remove residual toner remaining on the intermediate transfer belt 91 after the image transfer. The cleaner device 100 is arranged in a position between one of the photosensitive drums 711, which is in a most upstream position along a direction of rolling for the intermediate transfer belt 91, and the secondary-transfer roller 93. The cleaner device 100 includes a case 140 accommodating a cleaning roller 110, a collecting roller 120, and an auger 130.

The cleaning roller 110 rotates on the upper external surface of the intermediate transfer belt 91 to remove the residual toner from the surface. In particular, the cleaning roller 110 removes the residual toner in cooperation with a backup roller 111, which is arranged in an opposite position across the intermediate transfer belt 91, with predetermined bias applied to the cleaning roller 110 toward the backup roller 111.

The removed residual toner is passed to the collecting roller 120 as the collecting roller 120 and the cleaning roller 110 rotate. The collecting roller 120 is a roller arranged to have a circumference thereof to be in contact with a circumference of the cleaning roller 110. The collected residual toner is scraped off from the circumference of the collecting roller 120 by a blade (unsigned) and forwarded to an auger room 141, which accommodates the auger 130.

Figure 6A:
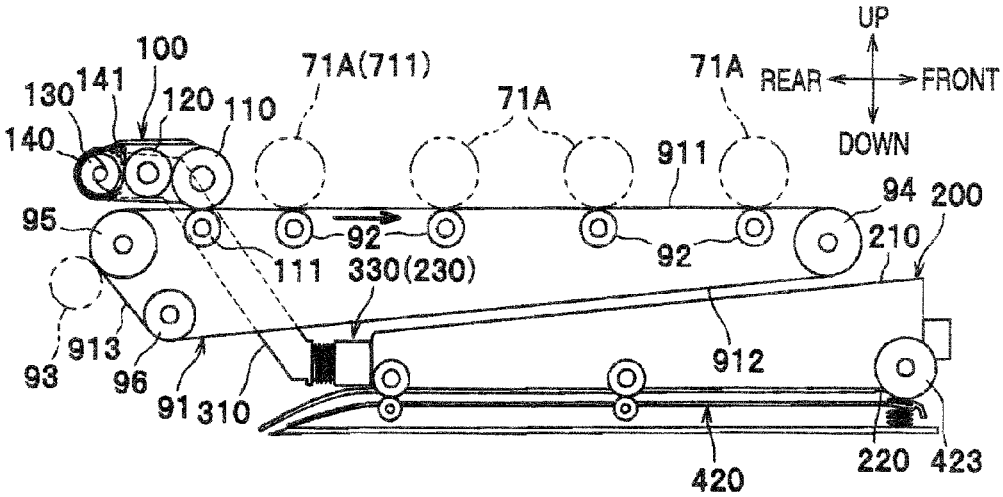
FIGS. 6A and 6B are an illustrative side view and a top plane view of an intermediate transfer belt, a cleaner device, a connector, and the waste toner container in the MFP according to the embodiment of the present invention.
Figure 6B:
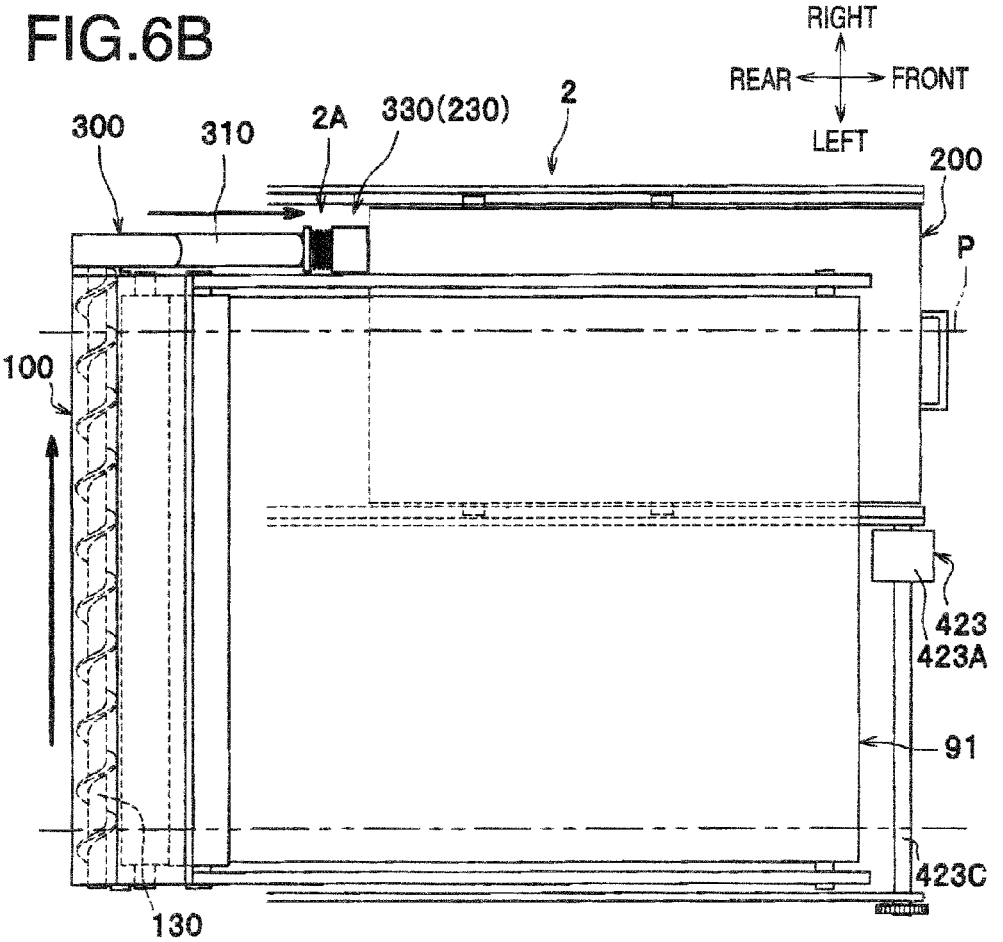
Figure 7A:
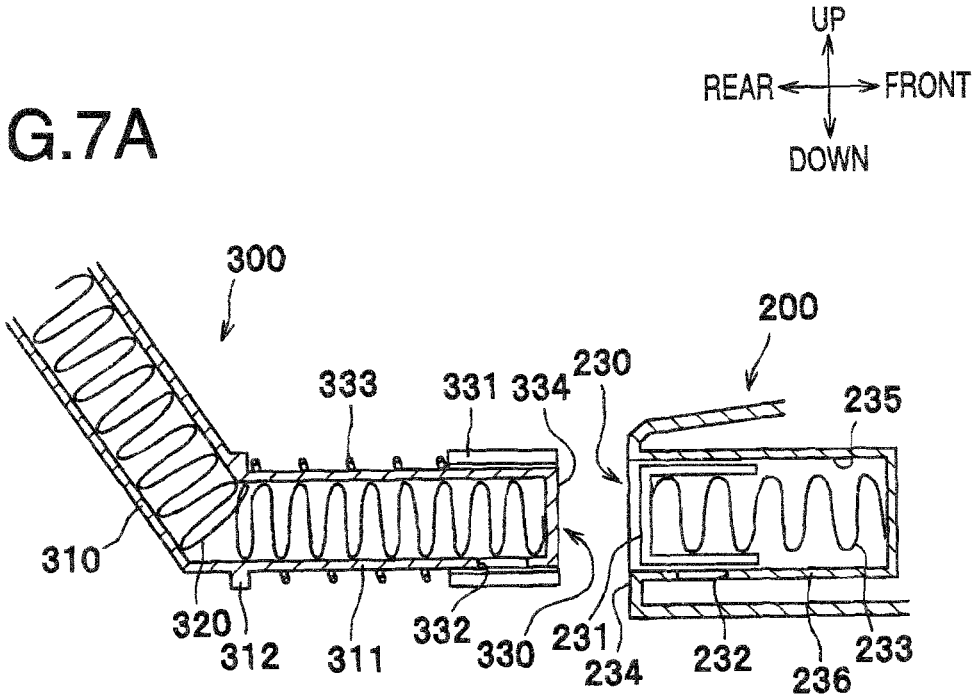
FIG. 7A is a cross-sectional side view of the connector detached from the waste toner container in the MFP according to the embodiment of the present invention.
Figure 7B:
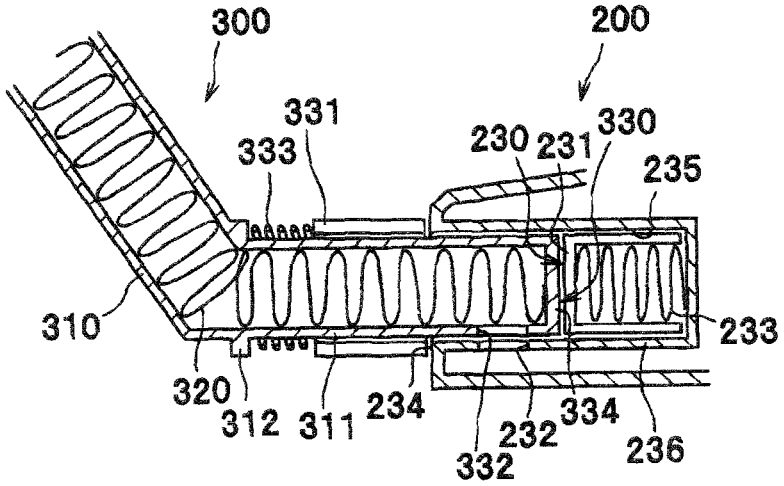
FIG. 7B is a cross-sectional side view of the connector attached to the waste toner container in the MFP according to the embodiment of the present invention.
Figure 8:
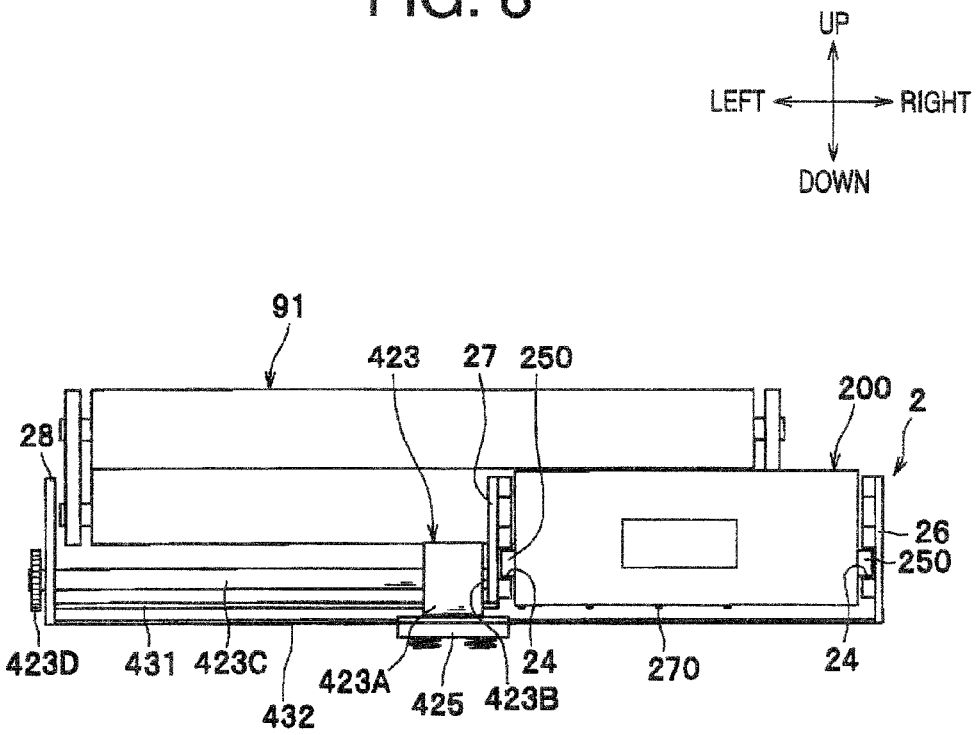
FIG. 8 is a front view of the intermediate transfer belt, the cleaning device, the connector, and the waste toner container in the MFP according to the embodiment of the present invention.

The auger 130 is a roller having a spiral twining around a shaft (see FIG. 6B). As the auger 130 rotates about the shaft, the residual toner collected in the auger room 141 is carried outside one of widthwise (i.e., the right-left direction) ends of the intermediate transfer belt 91. In the present embodiment, the auger 130 carries the residual toner rightward. The toner carried rightward by the auger 130 is forwarded to the waste toner container 200 via a connector 300. The flow of the collected toner is indicated by thick arrows shown in FIG. 6B.

The connector 300 (see FIGS. 7A and 7B) connecting the cleaning device 100 with the waste toner container 200 will be described. The connector 300 is a pipe, which is connected to the cleaner device 100 at one end and to which the waste toner container 200 is detachably attached at the other end. The connector 300 includes a shell 310 being a pipe, which is arranged on a left side of the intermediate transfer belt 91 in clearance 2A between the widthwise end of the intermediate transfer belt 91 and the chassis 2. The connector 300 further includes a spring auger 320, which is arranged inside the shell 310 and rotatable within the shell 310 to convey the toner in an axial direction.

The connector 300 includes a connector joint 330 at a front end portion of the shell 310. The joint 330 is attachable to a receptacle joint 230 of the waste toner container 200 when the waste toner container 200 is installed in the chassis 2. Thus, the joints 230, 330 are mutually attachable and arranged in positions to align in the front-rear direction to face each other when the waste toner container 200 is inserted through the opening 21A and pushed inward to be completely installed.

The joints 230, 330 are provided with sealers 231, 331 respectively, which are slidable in the direction of installation and removal of the waste toner container 200 to cover and uncover openings 232, 332 formed in the waste toner container 200 and the shell 310. The sealers 231, 331 are pushed in the positions to cover the openings 232, 332 by resiliency of coil springs 233, 333. When the waste toner container 200 is attached to the connector 300, the sealers 231, 331 are pushed frontward and rearward respectively by a rear end edge 234 of the waste toner container 200 and a front end surface 334 of the connector 300 against the resiliency of the coil springs 233, 333.

More specifically, the sealer 331 of the connector 300 is a cylindrical sleeve and slidable in the front-rear direction with respect to a circumference 311 of the shell 310. Meanwhile, the sealer 231 of the waste toner container 200 is formed to have a cylinder with a closed rear end. The sealer 231 is arranged in a pit 235 formed in a rear-end section of the waste toner container 200 with an open end thereof facing front and slidable in the front-rear direction with respect to the waste toner container 200 within the pit 235. The opening 332 of the connector 300 is formed in a bottom part of the circumference 311 of the shell 310. The opening 232 of the waste toner container 200 is formed in a bottom part of a circumference 236 of the pit 235. The openings 232, 332 are formed in positions to coincide with each other when the waste toner container 200 is attached to the connector 300.

The coil spring 333 of the connector 300 is arranged in a position between the sealer 331 and an annular flange 312, which is formed to protrude outward from the outer circumference 311 of the shell 310. The coil spring 233 of the waste toner container 200 is arranged between a closed end of the sealer 231 and a closed end of the pit 235. The front end surface 334 of the shell 310 defines a front end surface of the shell 310 and accommodated within an inner diameter of the sealer 331. The rear end edge 234 of the pit 235 in the waste toner container 200 is formed to surround the sealer 231.

When the waste toner container 200 is attached to the connector 300, the sealer 331 is pushed rearward by the rear end edge 234 against the expandable force of the coil spring 333. At the same time, the sealer 231 is pushed frontward by the front end surface 334 of the shell 310 against the expandable force of the coil spring 233. Accordingly, the opening 332 of the connector 300 and the opening 232 of the waste toner container 200 coincide with each other to be connected (see FIG. 7B), and the collected toner is allowed to pass through the openings 332, 232 to be carried to the waste toner container 200.

The joints 230, 330 are arranged in a position outside width (length in the right-left direction) of the sheet P being carried in a second feeding path 420 (see FIG. 6B), which will be described later in detail.

The waste toner container 200 accommodates waste toner and is detachably attached to the chassis 2 in a lower position with respect to the intermediate transfer belt 91 on an opposite side from the photosensitive drums 71A. In other words, the waste toner container 200 and the photosensitive drums 71A are arranged in positions opposite from each other across the intermediate transfer belt 91 (see FIG. 1). The waste toner container 200 is arranged in vertically displaced position from, and in adjacent to, a second feed roller 423, which extends underneath the intermediate transfer belt 91 in a left-side range in the chassis 2 between an inner left surface of the chassis 2 and a widthwise central area of the chassis 2. In other words, the waste toner container 200 is arranged side by side on a right-hand side within the chassis 2 with the second feed roller 423 (see FIG. 8) to align the second feed roller 423 along an axial direction of the second feed roller 423. According to this arrangement, the waste toner container 200 can be installed in and removed from the chassis 2 through the opening 21A along the front-rear direction without being interfered with by the second feed roller 423 (see also FIG. 4).

In the present embodiment, the second feed roller 423 is arranged in a position to fall within a vertical range of the waste toner container 200. More specifically, a lowermost part of the second feed roller 423 slightly projects downwardly from a lower plane 220 of the waste toner container 200. In other words, the waste toner container 200 is in a horizontally and partially overlapping position with the second feed roller 423 along the axial direction of the second feed roller 423. Therefore, compared to an MFP having the waste toner container and the second feed roller, which are arranged vertically overlapping positions, the chassis 2 of the MFP 1 can be downsized in the height thereof.

The second feed roller 423 is a driving and separator roller to separate one of the sheets P inserted through the external-sheet inlet 421 from the others and convey the separated sheet P further in the second feeding path 420. The second feed roller 423 will be described later in detail.

Figure 9A:
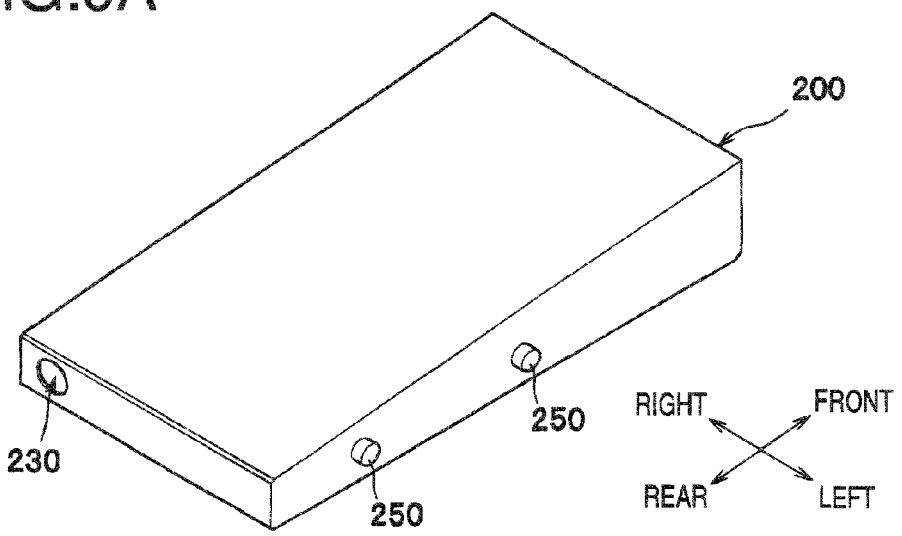
FIG. 9A is a perspective view of the waste toner container from top in the MFP according to the embodiment of the present invention.

As shown in FIG. 6A, the waste toner container 200 is formed to have a trapezoidal wedge-like cross-section having an upper plane 210, which faces the second plane 912 of the intermediate transfer belt 91 and extends there-along, and a lower plane 220, which extends in parallel with the first plane 911 of the intermediate transfer belt 91. More specifically, the lower plane 220 210 is inclined upwardly toward front with a rear end thereof being lower than a front end thereof. A front side of the waste toner container 200 comes in the vicinity of the driving roller 94 inside the intermediate transfer belt 91 and extends in parallel with the front cover 22A (see FIG. 1) when the waste toner container 200 is settled in the cassis 2. Further, the waste toner container 200 is formed to have the joint 230 on a rear side thereof (see FIG. 9A).

Figure 9B:
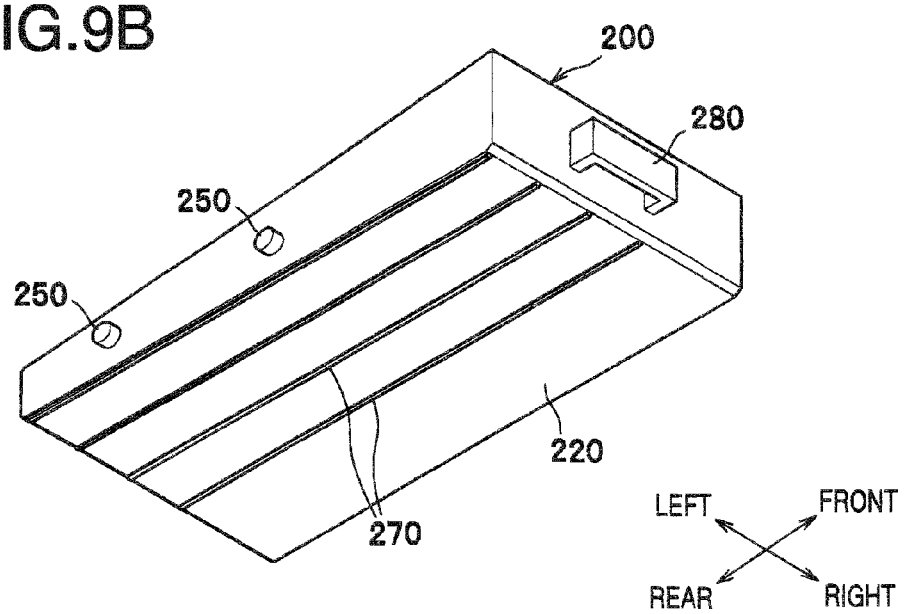
FIG. 9B is a perspective view of the waste toner container from bottom in the MFP according to the embodiment of the present invention.

The waste toner container 200 is formed to have a pair of guide pins 250 (see FIGS. 9A and 9B), which project outwardly, on each of a right side surface and a left side surface of the waste toner container 200. As the waste toner container 200 is installed in the chassis 2 through the opening 21A, the guide pins 250 are inserted in guide grooves 24 (see FIG. 4), which are formed on an inner (leftward) surface of a right-side wall 26 of the chassis 2 and on a rightward surface of a center wall 27 (see FIG. 8), and the waste toner container 200 is smoothly guided to a position, in which the waste toner container 200 is attached to the connector 300. The center wall 27 is a supporting wall arranged in the widthwise center area in the lower section in the chassis 2 with respect to the intermediate transfer belt 91 and extends in parallel with the right-side wall 26. The guide grooves 24 are formed to have height thereof to be smaller in an area closer to the rear of the chassis 2 and greater in an area closer to the front of the chassis 2 so that the guide pins 250 are more easily received in the guide grooves 24 in the area closer to the front.

Furthermore, the waste toner container 200 is formed to have ribs 270 (see FIG. 9B), which protrude downwardly from an outer surface of the lower plane 220 and extend along the front-rear direction, when installed in the chassis 2. The ribs 270 are formed to face the second feeding path 420, when the waste toner container 200 is installed, and serve as a part of a sheet guide 430 (an upper guide 431) to guide the sheet being carried in the second feeding path 420. In other words, the ribs 270 form a part of the second feeding path 420.

The waste toner container 200 is further formed to have a handle 280 (see FIG. 8B), which can be grabbed to be handled by a user, on the front side thereof.

Figure 5:
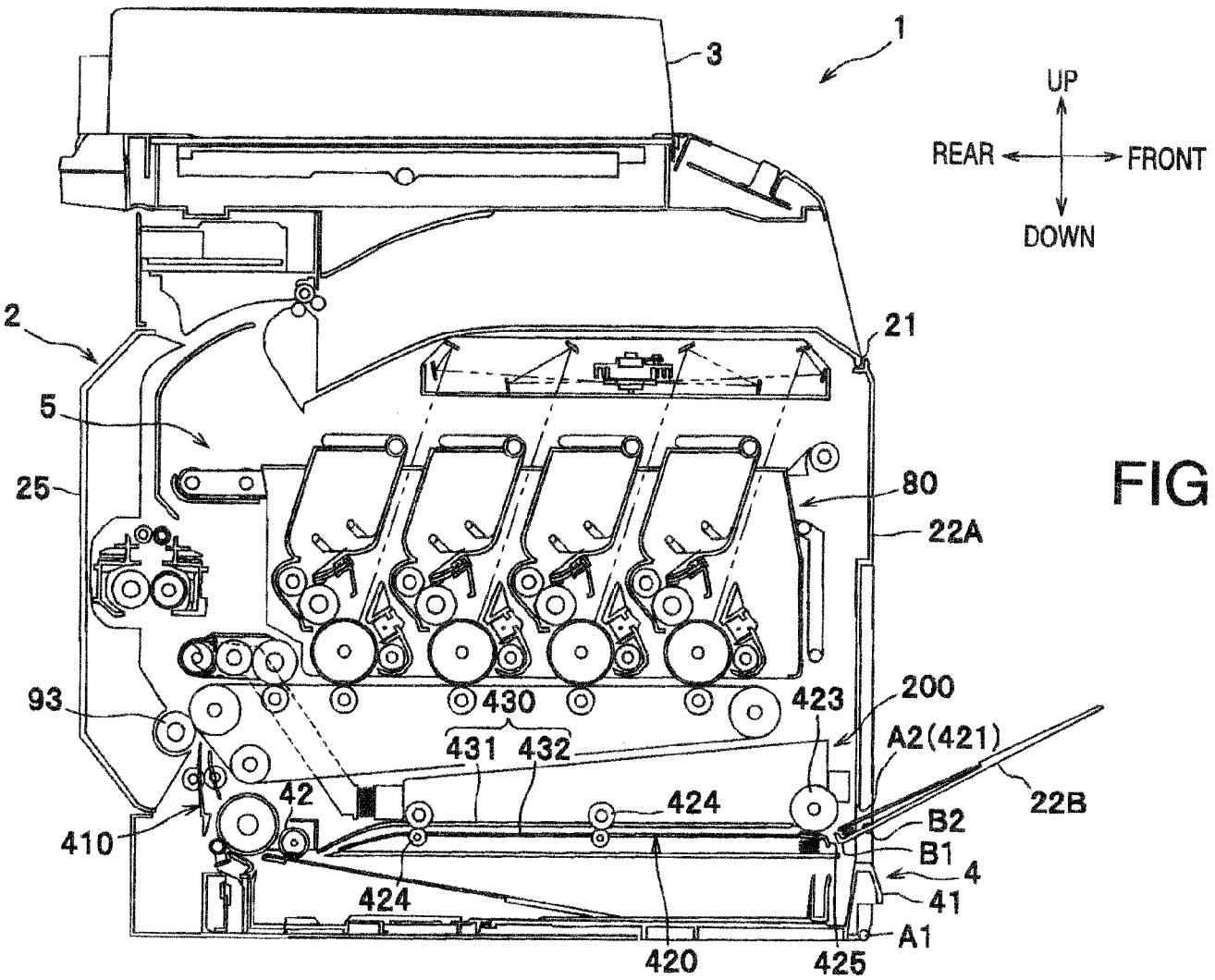
FIG. 5 is a cross-sectional side view of the MFP with an external feed tray in an open position in the MFP according to the embodiment of the present invention.

The second feeding path 420 is formed in between the waste toner container 200 and the sheet-feed tray 41 (see FIG. 5). The second feeding path 420 is a path for a manually-supplied sheet and extends from the front side 21 toward the rear side 25 of the chassis 2 along the lower plane 220 of the waste toner container 200. The second feeding path 420 merges into a first feeding path 410, which ranges between the first feed roller 42 and the secondary-transfer roller 93.

More specifically, in the second feeding path 420, the external-sheet inlet 421, the sheet guide 430, the second feed roller 423, and conveyer rollers 424 are provided. The sheet guide 430 extends in a range between the external-sheet inlet 421 and the first feed roller 42. The sheet is conveyed by the second feed roller 423 and the conveyer rollers 424 from the external-sheet inlet 421 to the vicinity of the first feed roller 42 along the second feeding path 420 in the sheet guide 430 and further fed in the first feeding path 410.

The second feed roller 423 is a driving and separator roller to separate one of the sheets P inserted through the external-sheet inlet 421 from the others and convey the separated sheet P further in the second feeding path 420. The second feed roller 423 is arranged in a position within the second feeding path 420 closer to the front with respect to the waste toner container 200. The second feed roller 423 includes a rod 423A, a rotation shaft 423B, and a driving shaft 423C (FIGS. 6B and 8), which are coaxially and integrally rotatable. The rod 423A is a larger diameter part of the second feed roller 423 to become in contact with a separator pad 425 or the sheet P being inserted through the external-sheet inlet 421. A diameter of the rod 423A is larger than a diameter of the driving shaft 423C and the rotation shaft 423B. The rod 423A is arranged in vicinity of the widthwise central area of the chassis 2. The rotation shaft 423B extends in a right-side range with respect to the rod 423A. The driving shaft 423C extends in a left-side range with respect to the rod 423A.

The rotation shaft 423B is rotatably supported by the center wall 27 of the chassis 2. The driving shaft 423C is rotatably supported by a left-side wall 28, which is arranged in an inner position with respect to a left-side plane of the chassis 2. The driving shaft 423C penetrates the left-side wall 28 to protrude outwardly from the left-side wall 28, and a driving gear 423D is fixed to the protruded left-side end of the driving shaft 423C. When driving force from a motor (not shown) in the chassis 2 is transmitted through the driving gear 423D, the driving shaft 423C is rotated along with the rod 423A and the rotation shaft 423B.

Meanwhile, the aforementioned connector 300 is arranged in a position opposite from the driving shaft 423C with respect to the rod 423A along the axial direction of the second feed roller 423. In other words, the second feed roller 423 is out of a course of the waste toner container 200 being connected with the connector 300. According to this arrangement, when the waste toner container 200 is installed in and removed from the chassis 2, the waste toner container 200 can be moved without being interfered with by the driving shaft 423C.

The sheet guide 430 includes an upper guide 431 and a lower guide 432 being arranged in a lower position with respect to the upper guide 431 (see FIG. 5). The upper guide 431 and the lower guide 432 are arranged to have clearance therebetween for the manually-supplied sheet P to pass therethrough.

The upper guide 431 is formed to extend in a range between the external-sheet inlet 421 and a position in vicinity of the first feed roller 42. Further, whilst the waste toner container 200 is arranged in a front position with respect to a front end of the upper guide 43, the ribs 270 formed on the outer surface of the lower plane 220 of the waste toner container 200 serve as a part of the upper guide 431 (see FIG. 8).

The lower guide 432 is formed to extend in a range between a position in vicinity of the external-sheet inlet 421 and a position in the vicinity of the first feed roller 42.

The conveyer rollers 424 are a plurality of (e.g., two) pairs of rollers to convey the sheet P in the second feeding path 420. Each pair includes an upper roller and a lower roller, which are arranged in the upper guide 431 and the lower guide 432 respectively. One of the pairs is arranged in vicinity of a center of the upper guide 431 and the lower guide 432, and another one of the pairs is arranged in a rear position of the upper guide 431 and the lower guide 432.

According to the MFP 1 with the above-described configuration, the waste toner container 200 is arranged in the vertically displaced position from the second feed roller 423; therefore, the waste toner container 200 being installed in and removed from the chassis 2 through the opening 21A can be moved without being interfered with by the second feed roller 420. Thus, the waste toner containers 200 can be exchanged through the front side of the chassis 2 of the MFP 1. Further, with the second feed roller 423, which is at least partially arranged within the height of the waste toner container 200, the chassis 2 can be smaller in the height thereof compared to an MFP having the vertically overlapping waste toner container and the second feed roller.

According to the above-described configuration, the driving shaft 423C of the second feed roller 423 is arranged on the opposite side from the waste toner container 200 across the center wall 27, the waste toner container 200 can be installed in and removed from the chassis 2 without being interfered with by the driving shaft 423. Therefore, a used waste toner container 200 can be easily replaced with an unused waste toner container 200.

According to the above-described configuration, the connector 30 is arranged on the opposite side from the driving shaft 423C across the rod 423A of the second feed roller 423; therefore, the waste toner container 200 being installed in and removed from the chassis 2 can be connected to and disconnected from the connector 300 without being interfered with by the driving shaft 423C of the second feed roller 423.

According to the above-described configuration, the ribs 270 formed on the outer surface of the lower plane 220 of the waste toner container 200 serve as the guide for the sheet P in the second feeding path 420. Therefore, when the waste toner container 200 is removed out of the chassis 2, a right-side front part of the second feeding path 420 is exposed to be accessible through the opening 21A. Accordingly, when the sheet P is stuck in the second feeding path 420, the user can access the second feeding path 420 simply by removing the waste toner container 200 out of the chassis 2 to remove the jammed sheet.

According to the above configuration, the drawer 80 holding the processing cartridges 70 is removable through the opening 21A. Therefore, when exchange of the processing cartridges 70 is required, the user can access the processing cartridges 70 from the same side of the chassis 2 as the side, from which the user accesses the waste toner container 200 and the external-sheet inlet 421. Thus, the user's convenience for handling the MFP 1 is improved.

According to the above configuration, the waste toner collected by the cleaner device 100 is conveyed sideward by the auger 130 to the right. The waste toner is further carried to the waste toner container 200 by the connector 300, which is arranged in the clearance 2A formed on the right side of the intermediate transfer belt 91. Therefore, the waste toner can be efficiently carried in a shorter distance from the cleaner device 100 to the waste toner container 200. With the minimum configuration to carry the waste toner, the MFP 1 can be downsized.

According to the above configuration, the joints 230, 330 are arranged in the positions to oppose to each other in line in the installation/removal direction of the waste toner container 200. Accordingly, the structure of the connector 300 can be simplified compared to a connector with joints being arranged to oppose to each other in right-left direction, which is perpendicular to the installation/removal direction of the waste toner container 200.

According to the above configuration, the joints 230, 330 are arranged outside the width of the sheet P being carried in the second feeding path 420. Accordingly, even if the waste toner leaks through the joints 230, 330, the toner may not necessarily fall on the sheet being carried, and the sheet P is prevented from being ruined by the leaked toner.

According to the above configuration, when the joint 230 is detached from the joint 330, the sealers 231, 331 are automatically moved in the positions to cover the openings 232, 332. Thus, fall of the toner from the openings 232, 332 is prevented. Further, the connector 300 is efficiently handled by the automatic closing/opening structure of the sealers 231, 331. For example, compared to joints having sealers, which are manually moved by separately provided manipulation members, the structure of the connector 300 in the above embodiment is more simplified.

According to the above configuration, the sheet P being carried by the first feed roller 42 becomes in contact with the third plane 913 of the intermediate transfer belt 91 before the sheet P enters the nipped position between the intermediate transfer belt 91 and the secondary-transfer roller 93. Therefore, the electrical discharge between the third plane 913 and the sheet P can be reduced.

According to the above configuration, with the intermediate transfer belt 91 having the wedge-shaped cross-section and the waste toner container 200 having the wedge-shaped cross-section, which are arranged in the vertically overlapping positions to substantially form a rectangular solid, the space inside the chassis 2 is efficiently used. Accordingly, the chassis 2 of the MFP 1 can be downsized in the height thereof.

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

Figure 10:
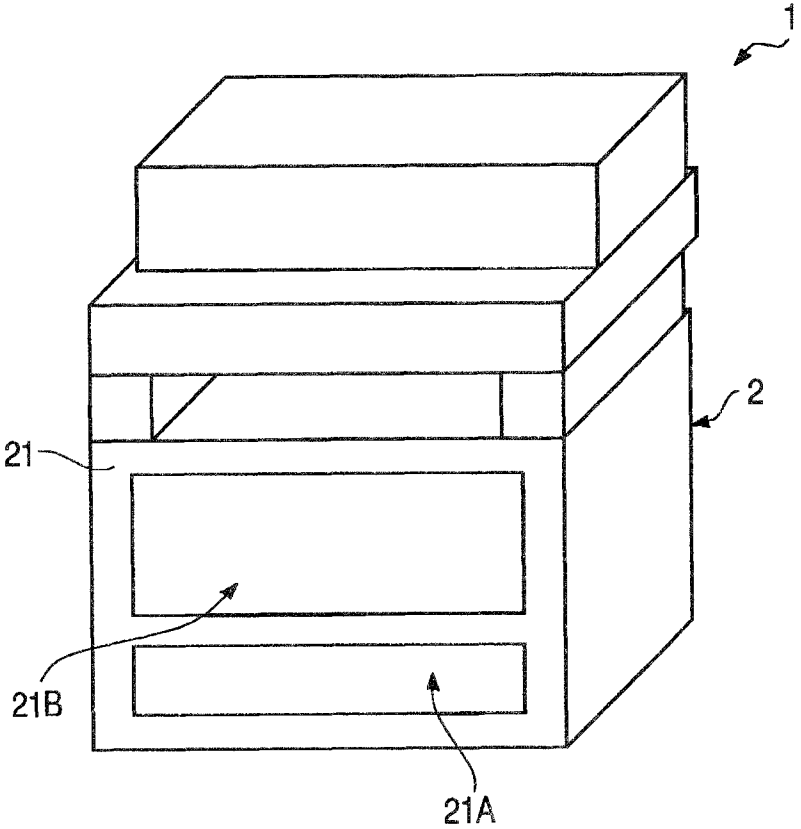
FIG. 10 is a diagram to illustrate two separately-formed openings for the waste toner container and for the drawer in a front side of the MFP according to an embodiment of the present invention.

For example, although in the above embodiment, the single opening 21A to allow the installation and removal of both the drawer 80 and the waste toner container 200 is formed. However, an opening 21A for the drawer 80 and a different opening 21B (see FIG. 10) for the waste toner container 200 may be separately formed, and covers (not shown) to respectively cover/uncover the two openings 21A, 21B may be provided.

In the above-described example, the waste toner container 200 is arranged in adjacent to the second feed roller 423, of which rod 423A is in the widthwise central area of the chassis 2. However, for example, the waste toner container 200 and the second feed roller 423 may not necessarily be in the adjoining positions but may be arranged in positions apart from each other as long as the waste toner container 200 and the second feed roller 423 are in vertically displaced positions.

For another example, the second feed roller 423 may not necessarily be partially included within the height of the waste toner container 200 but may be arranged to be entirely included within the height of the waste toner container 200.

For another example, the side, in which the opening 21A and the external-sheet inlet 421 are formed, may not necessarily be the front side, but may be the right or the left side. Further, the photosensitive drums 71A may be replaced with, for example, photosensitive belts.

The structures of the cleaner device 100 and the connector 300 may not be limited to those described above. For example, a cleaner device 100 without the collecting roller 120 may be used. Alternatively or additionally, a connector 300 without the spring auger 320 may be employed. Furthermore, a connector 300 may be provided with a cover being slidable along a plane, in which the opening is formed.

Further, the primary-transfer rollers 92 may be replaced with, for example, conductive brushes or conductive blade springs, as long as the primary-transfer members are capable of bearing the applied transfer bias.

In the embodiment described above, the second feed roller 423 being a driving roller separates the sheet P in cooperation with the separator pad 425. However, for example, the second feed roller may separate the sheet P in cooperation with a paired driven roller. Further, the second feed roller may not necessarily be a driving roller but may be a driven roller, which can be driven by a paired driving roller.

Further, for example, the auger 130 with the spiral may be replaced with a spring auger. For another example, the waste toner container 200 may not necessarily be installed and removed in the horizontal direction, but may be installed and removed in an angled direction with respect to the horizontal direction.

The embodiment described above may not necessarily be applied to a multicolor MFP, but may be employed in, for example, a printer and a copier. Further, the sheet may not necessarily be paper but may be, for example, an OHP sheet.

What is claimed is:

1. An image forming apparatus configured to form toner images on a recording sheet, comprising:

a chassis;

a plurality of photosensitive members configured to be stored in the chassis and to carry the toner images;

an intermediate transfer belt including an endless belt, the intermediate transfer belt being configured to roll in a predetermined rolling direction, being arranged to have a surface thereof facing the plurality of photosensitive members, and being configured to have the toner images on the plurality of photosensitive members transferred onto the surface;

a sheet feed tray configured to store the recording sheet;

a first sheet feeding path extending from the sheet feed tray to the intermediate transfer belt;

a second sheet feeding path arranged in between the sheet feed tray and the intermediate transfer belt, the second sheet feeding path being merged into the first sheet feeding path;

a sheet feed roller arranged on the second sheet feeding path;

a connector comprising a first joint;

a waste toner container comprising a second joint, the second joint being attachable to the first joint of the connector, the waste toner container being configured to accept residual toner collected from the intermediate transfer belt through the second joint, and the waste toner container being arranged on a side closer to the connector with respect to the sheet feed roller on the second feeding path along a direction of axes of the photosensitive members.

2. The image forming apparatus according to claim 1, wherein the second joint is arranged on an outer side one end of the intermediate transfer belt along the direction of axes of the photosensitive members.

3. The image forming apparatus according to claim 1, wherein the sheet feed roller comprises a plurality of sheet feed rollers arranged on the second sheet feeding path.

4. The image forming apparatus according to claim 1, wherein the sheet feed roller is at least partially arranged within a height of the waste toner container.

5. The image forming apparatus according to claim 1, further comprising:

a cleaner device configured to collect the residual toner from the intermediate transfer belt.

6. The image forming apparatus according to claim 5, wherein the cleaner device comprises an auger configured to convey the residual toner along the direction of axes of the photosensitive members.

7. The image forming apparatus according to claim 5, further comprising:

a resilient member configured to push the second joint of the waste toner container along an attachable direction, in which the second joint is attached to the cleaner device.

8. The image forming apparatus according to claim 1, wherein the second joint comprises an aperture formed on one side of the waste toner container.

9. The image forming apparatus according to claim 1, wherein the second joint is arranged in on a leading side of the waste toner container with regard to a direction of installing the waste toner container in the chassis.

10. The image forming apparatus according to claim 9, wherein the waste toner container comprises a handle arranged on a side opposite from the second joint with regard to the direction of installing the waste toner container.

11. The image forming apparatus according to claim 1, further comprising:

a holder configured to hold the plurality of photosensitive members, wherein the chassis is formed to have an opening;

wherein the holder is movable through the opening between a first position, in which the holder is accommodated in the chassis, and a second position, in which the holder is removed out of the chassis.

12. The image forming apparatus according to claim 1, wherein the waste toner container comprises a guide pin configured to guide the waste toner container when the waste toner container is moved with respect to the chassis.

13. The image forming apparatus according to claim 12, wherein the chassis comprises a guide groove configured to guide the guide pin of the waste toner container when the waste toner container is moved with respect to the chassis.

* * * * *